United States Patent [19]

Joseph et al.

[11] Patent Number: 4,465,356

[45] Date of Patent: Aug. 14, 1984

[54] MAGNETIC BRUSH DEVELOPER APPARATUS

[75] Inventors: Brian J. Joseph, Rochester; James O. Williams, Hilton, both of N.Y.

[73] Assignee: Eastman Kodak Company, Rochester, N.Y.

[21] Appl. No.: 355,834

[22] Filed: Mar. 8, 1982

[51] Int. Cl.[3] ..... G03G 15/09

[52] U.S. Cl. ..... 355/3 DD; 118/657; 118/658; 355/4

[58] Field of Search ..... 355/3 DD, 4; 118/656, 118/657, 658, 661

[56] References Cited

U.S. PATENT DOCUMENTS

| | | | |
|---|---|---|---|
| 3,233,781 | 2/1966 | Grubbs . | |
| 3,570,453 | 3/1971 | Nuzum . | |
| 3,572,288 | 3/1971 | Turner . | |
| 3,717,122 | 2/1973 | Hudson . | |
| 3,872,829 | 3/1975 | Rattin . | |
| 3,918,395 | 11/1975 | Fearnside | 118/657 X |
| 4,077,358 | 3/1978 | Kito | 118/658 |
| 4,260,239 | 4/1981 | Peperstraete et al. | 118/657 X |
| 4,266,328 | 5/1981 | Harada et al. | 355/3 DD X |

FOREIGN PATENT DOCUMENTS

| | | | |
|---|---|---|---|
| 1260309 | 2/1968 | Fed. Rep. of Germany | 355/3 DD |
| 53375 | 4/1980 | Japan | 355/3 DD |

*Primary Examiner*—Fred L. Braun

*Attorney, Agent, or Firm*—Lawrence P. Kessler

[57] ABSTRACT

Magnetic brush developer apparatus for selectively developing an electrostatic charge pattern on a member by contacting the member with particulate magnetic developer material. The apparatus includes an applicator for transporting developer material in juxtaposition with such member. An electromagnet is operatively associated with the applicator for establishing developer nap bristles on the applicator when energized. The electromagnet is selectively energized to establish nap bristles to develop a selected electrostatic charge pattern with developer material and deenergized to avoid development of any non-selected electrostatic charge pattern.

5 Claims, 3 Drawing Figures

MAGNETIC BRUSH DEVELOPER APPARATUS

BACKGROUND OF THE INVENTION

This invention relates generally to electrographic developer apparatus, and more particularly to an improved magnetic brush developer apparatus having a selectively energizable electromagnet for forming the brush nap bristles to effect development of an electrostatic image.

In the electrographic process for making reproductions of input information, an electrostatic charge pattern is formed on the surface of an insulating member in image-wise configuration corresponding to the information to be reproduced. The charge pattern is developed by applying developer material to such pattern to form a visible image. The visible developer material image is then either transferred to a receiver member and fixed to such member, or fixed to the insulating member itself. In commercial high speed electrographic equipment, a common mechanism for developing electrostatic charge patterns is a magnetic brush developer apparatus.

A typical magnetic brush developer apparatus includes one or more magnets located within an applicator member. The applicator member may rotate about fixed magnets, or the magnets may rotate within a fixed applicator member. Developer material comprises, for example, a mixture of finely divided pigmented thermoplastic marking particles (toner) held to the surface of ferromagnetic particles (carrier) by electrostatic charges created by triboelectrification. The carrier particles, with the attached toner particles, are held on the applicator member in a bristle-like formation by the magnetic fields of the magnets to form a brush nap. Of course, developer material of the type comprised solely of marking particles which exhibit magnetic properties (referred to as single component developer) is also suitable. The developer material is then brought into contact with the electrostatic charge pattern by brushing the nap bristles across the surface of the insulating member. When the developer material contacts the surface of the insulating member, the electrostatic attraction for the triboelectrically charged toner particles by the charge pattern on the insulating member overcomes the attraction of the carrier particles for the toner particles and the pattern is developed (see, for example, U.S. Pat. No. 3,703,395, issued Nov. 21, 1972 in the name of Drexler et al).

Most magnetic brush developer apparatus utilize a cylindrical applicator member located in fixed spatial relation to the surface of the insulating member so that the brush nap of developer material is maintained in contact with the surface. However, in certain instances, it is desirable to selectively prevent the brush nap from contacting such surface. For example, in electrographically making multicolor reproductions, a plurality of related electrostatic charge patterns, corresponding respectively to color separation images of desired information to be reproduced, are formed on sequentially spaced areas of the insulating member (or on separate insulating members respectively). The electrostatic charge patterns are developed with complementary colored toner by a plurality of independent magnetic brush developer apparatus respectively. It is desirable that a brush nap of a particular one of the independent developer apparatus contact and developer only its respective charge pattern to prevent toner particles from the brush naps of the other developer apparatus from intermixing with, or scraping the toner particles of the such developed pattern.

The operation of the plurality of developer apparatus to develop only respective charge patterns has heretofore been accomplished, for example, by selectively elevating the independent magnetic brush developer apparatus so that their brush naps contact only respective charge patterns to be developed on the insulating member (see, for example, U.S. Pat. No. 3,854,449, issued Dec. 17, 1974, in the name of Davidson). Another manner in which the plurality of developer apparatus are selectively controlled to develop only respective charge patterns includes a plurality of mechanical skieves associated with the plurality of developer apparatus respectively. The skieves are selectively moved relative to their associated brush naps to regulate the height of the brush naps so that such naps contact only respective charge patterns to be developed (see, for example, U.S. Pat. No. 3,570,453, issued Mar. 16, 1971, in the name of Nuzum). Such development control mechanisms complicate the magnetic brush developer apparatus construction and are subject to failure due to the contaminating nature of the toner particles. Furthermore, they require a period of time to establish a developer material brush nap suitable for charge pattern development. Such period limits the operational speed of the reproduction apparatus because sufficient time must be provided in the reproduction process to establish the respective brush naps.

SUMMARY OF THE INVENTION

This invention is directed to an improved magnetic brush developer apparatus for developing an electrostatic charge pattern on a member by contacting the member with particulate magnetic developer material. The apparatus includes an applicator for transporting developer material in juxtaposition with such member. An electromagnet is operatively associated with the applicator for establishing developer nap bristles on the applicator when energized. The electromagnet is selectively energized to establish nap bristles to develop a selected electrostatic charge pattern with developer material and deenergized to avoid development of any non-selected electrostatic charge pattern.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
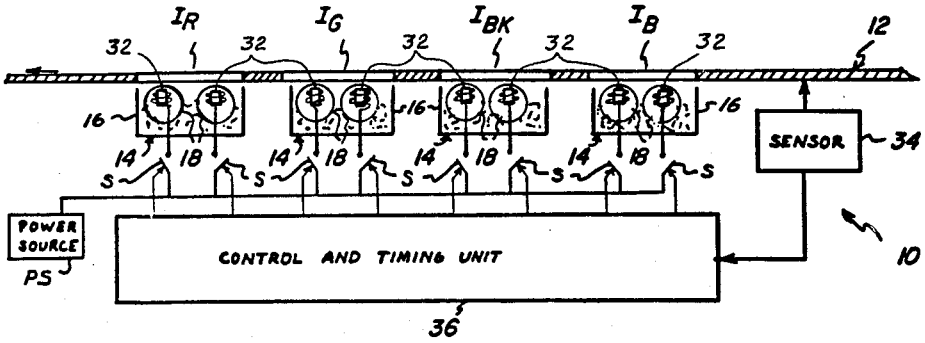
FIG. 1 is a schematic view of an assembly for developing a plurality of related electrostatic charge patterns on the surface of an insulating member with the improved magnetic brush developer apparatus according to this invention.

Referring now to the accompanying drawings, a developer assembly 10 having a plurality of magnetic brush developer apparatus 14 is schematically shown in FIG. 1. While the assembly 10 is illustratively described as having a plurality of magnetic brush developer apparatus for use in a multicolor electrographic process to respectively develop a plurality of related electrostatic charge patterns on the surface of an insulating member 12, the invention is of course applicable to a monochrome process in which only a single magnetic brush developer apparatus is employed.

The insulating member 12 is, for example, a moving composite web including an insulative layer, a grounded conductive layer, and a photoconductive layer, such as described in U.S. Pat. No. 3,615,414, issued Oct. 26, 1971 in the name of Light. As the member 12 is moved, the surface of its insulative layer is uniformly electrostatically charged. The charge is then selectively reduced in sequentially spaced areas by exposure of the photoconductive layer to color separation images of input information to be reproduced, such as a multicolor document. Such exposure forms spaced related electrostatic charge patterns (e.g. $I_R$, $I_G$, $I_B$) on the surface of the member 12 corresponding to the color separation images respectively. Additionally, an electrostatic charge pattern e.g. $I_{BK}$) of any black portion of the input information may also be formed on the surface. In order to reproduce the input information utilizing the subtractive color reproduction process, the charge patterns are respectively developed with pigmented marking particles (toner) which are complementary to the primary colors (and with black marking particles if a charge pattern corresponding to black information is formed) by the assembly 10. The toner particles in the illustrated embodiment are, for example, of the type disclosed in U.S. Pat. No. 3,893,935, issued July 8, 1975, in the name of Jadwin et al. However, single component developer material could alternatively be employed.

The developer assembly 10 includes a plurality of magnetic brush developer apparatus 14 located adjacent to the member 12. The apparatus 14 have respective housings 16 which serve as reservoirs for the pigmented toner particles and ferromagnetic particles (carrier). In the illustrative example of FIG. 1, the left most housing contains cyan toner particles, the left-center housing contains magenta toner particles, the right-center housing contains black toner particles, and the right-most housing contains yellow toner particles. Of course, this invention is suitably operative with other arrangements of particular colored toner particles contained in the housings respectively.

Figure 2:
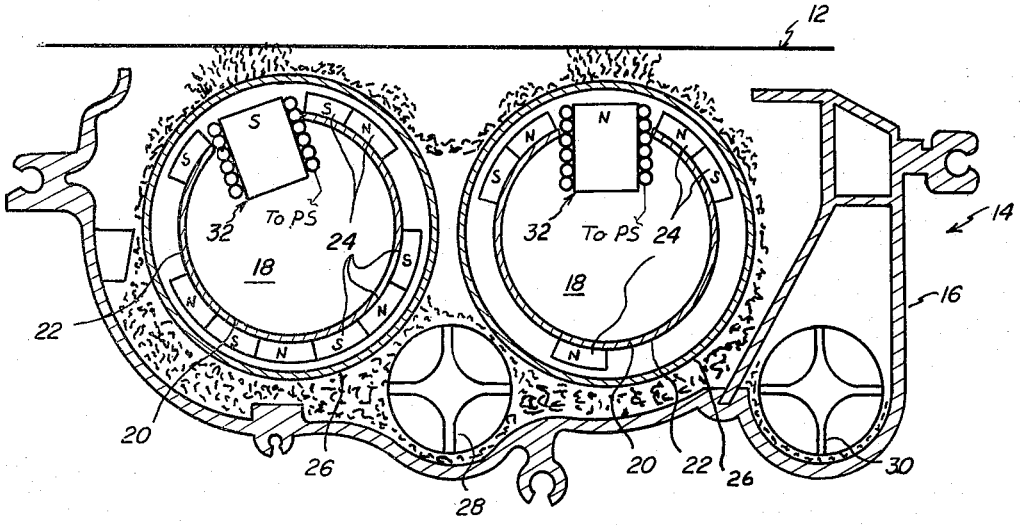
FIG. 2 is a side elevational view, partly in section, of the improved magnetic brush developer apparatus according to this invention, with the electromagnets energized.
Figure 3:
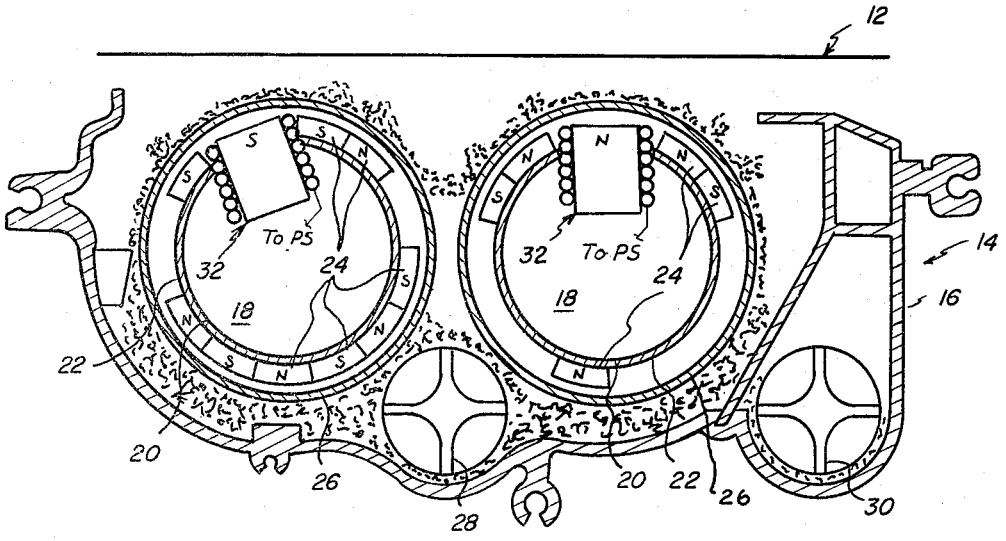
FIG. 3 is a side elevational view, partly in section, similar to FIG. 2, with the electromagnets deenergized.

The housings 16 respectively contain pairs of magnetic brushes 18. Of course, it is within the scope of this invention to provide any other suitable number of magnetic brushes within each housing. The magnetic brush developer apparatus 14 are of identical construction and, therefore, only one such apparatus will be described with particular reference to FIGS. 2 and 3. Stationary cylindrical cores 20, of a non-magnetic material such as aluminum, are mounted in the housing 16. Stationary magnetic pole pieces 22 are adhesively bonded to the cores 20. A plurality of permanent magnets 24, of rubber-bonded barium ferrite strips for example, are fixed on the periphery of the pole pieces 22. Applicator members 26, rotatably mounted in the housing 16 concentrically with respective cores 20, surround the magnet arrangement in the field of the permanent magnets. The applicator members 26 are hollow cylinders or tubes of non-magnetic material, such as aluminum, with a roughened peripheral surface.

Augers 28 and 30 circulate the carrier particles and toner particles so that the toner particles develop a triboelectric charge which causes such particles to adhere to the carrier particles. As the applicator members 26 rotate, the carrier particles (with adhering toner particles) are held on the roughened peripheral surfaces of the applicator members by the magnetic fields of the permanent magnets 24 and are moved with such members into juxtaposition with the member 12. The carrier and toner particles establish a brush nap in the form of bristles extending radially from the applicator members in the magnetic fields. The strength of the magnetic fields and the relative spacing between the member 12 and the apparatus 14 insure that the brush nap bristles do not contact the surface of such member.

Electromagnets 32 are mounted in the respective cores 20 of the brushes 18, within the applicator members 26, in the area where the applicator members are in close proximity to the member 12 (the development zone). The electromagnets are electrically coupled to a power source PS through respective switches S. When the electromagnets are energized, the field strengths of the electromagnets 32 enhance the formation of the brush nap bristles. That is, the electromagnets cause the brush nap bristles to immediately stand up on the surface of the rotating applicator members in the development zone to a height where the bristles contact the surface of the member 12 (see FIG. 2). During such contact, an electrostatic charge pattern on the moving member 12 has an attraction for the toner particles of a magnitude which overcomes the attraction of the carrier particles for the toner particles. Accordingly, toner particles are attracted from the carrier particles to the electrostatic charge pattern to develop the pattern and form a visible image. When the electromagnets 32 are deenergized, the brush nap bristles in the development zone immediately collapse out of contact with the member 12 (see FIG. 3). Thus, even if the member 12, passing over the rotating applicator members 26, bears an electrostatic charge pattern, such pattern will not be developed.

Of course, other locations for the electromagnets accomplish the desired result of this invention. For example, an electromagnet is suitably located within the applicator members 26 upstream from the development zone, whereby deenergization of such electromagnet prevents brush nap bristles from being formed on the applicator member (starves the brush nap) so that a charge pattern on the member 12 would not be developed. In another arrangement the electromagnet is suitably located adjacent to the applicator member on the opposite side of the member 12. Such electromagnet has a field strength on energization to alternatively establish the brush bristles on the applicator member in contact with the member 12 in the development zone or to keep the brush bristles out of contact with the member 12.

Referring now to FIG. 1, a sensor 34 detects electrostatic charge patterns on the insulating member 12. Such detection may be accomplished, for example, by sensing marks associated with respective charge patterns. The sensor 34, which may be of the type disclosed in U.S. Pat. No. 4,025,186 issued May 24, 1977 in the name of Hunt, Jr. et al for example, produces signals indicative of the position of the respective patterns. Such signals are transmitted to a control and timing unit 36 operatively coupled to the switches for the electromagnets 32 of the magnetic brush developer apparatus 14. The unit 36 includes a microprocessor, for example, which selectively actuates the switches in timed relation to the passage of a pattern to be developed by a particular developer apparatus. For example, when the electrostatic charge pattern $I_R$ (corresponding to the red color separation image of the input information) on the moving member 12 travels through the developer assembly 10, it is detected by the sensor 34 which sends an appropriate signal to the unit 36. After a time interval which places such pattern adjacent to the magnetic brush developer apparatus having cyan toner particles (left-most apparatus in FIG. 1), the unit 36 energizes the electromagnets of such apparatus to immediately stand the brush nap bristles up on its applicator member into contact with the web to develop such pattern. Of course, the remaining electromagnets remain deenergized as such pattern passes thereover so that no development occurs.

In a similar manner, charge pattern $I_G$ corresponding to the green color separation image is detected and developed only with magenta toner particles, charge pattern $I_{BK}$ corresponding to the black image is detected and developed only with black toner particles, and charge pattern $I_B$ corresponding to the blue color separation image is detected and developed only with yellow toner particles. Thus, the related patterns on the web 12 are developed only with respective pigmented toner particles to form spaced visible toner particle images complementary to the color separation images of the input information to be reproduced. Subsequently the developed images may be transferred in accurate register and fixed to a receiver sheet, such as by the apparatus shown in U.S. Pat. No. 4,251,154 issued Feb. 17, 1981 in the name of Russel for example, to make the desired multicolor reproduction.

With the improved magnetic brush developer apparatus of this invention, the selective energization of the electromagnets of such apparatus eliminates the need for mechanical magnetic brush control arrangements found in the prior art. The control of the brush nap bristles provided by the electromagnets prevents contamination or degradation of developed images by toner particles of adjacent brush naps. Further, the brush nap bristles are substantially immediately available for development so that there is no need to provide a time delay period in the development process to allow an effective brush nap to be established.

This invention has been described in detail with particular reference to a preferred embodiment thereof, but it will be understood that variations and modifications can be effected within the spirit and scope of the invention.

We claim:

1. In an apparatus for selectively developing an electrostatic charge pattern on an insulating member, such apparatus including a housing for containing particulate magnetic developer material, an applicator member mounted in said housing for movement in juxtaposition with such insulating member, means for magnetically attracting such material to said applicator member to form a nap of bristles on the applicator member, and means for relatively moving said applicator member and said magnetic means to position such bristles adjacent to but in non-contact relation with the charge pattern on such insulating member, the improvement comprising:

an electromagnetic in said housing associated with said applicator member, for establishing when such electromagnet is energized, upstanding nap bristles on the applicator member to contact a charge pattern on such insulating member; and means for selectively (i) energizing said electromagnet to develop a selected electrostatic charge pattern with developer material attracted to the contacted charge pattern and (ii) deenergizing said electromagnet to avoid development of any non-selected electrostatic charge pattern.

2. The invention of claim 1 wherein said applicator member is positioned between said electromagnet and such insulating member.

3. The invention of claim 1 wherein said energizing means includes means for detecting a selected electrostatic charge pattern on the insulating member when such pattern is in juxtaposition with said applicator member, and means associated with said detecting means for energizing or deenergizing said electromagnet in response to detection of non-selected electrostatic charge pattern.

4. Apparatus for developing a plurality of related electrostatic charge patterns spaced on pattern-carrying means moving along a path, said apparatus comprising:

a plurality of housings, corresponding in number to the number of related electrostatic charge patterns, positioned adjacent to said path, said housings being adapted to contain magnetic developer material;

a plurality of applicator members, mounted in said plurality of housings respectively, and means for moving said applicator members into operative association with such developer material and into juxtaposition with such moving pattern-carrying means;

means for forming a nap of bristles of developer material on said applicator members respectively, said means including a plurality of electromagnets associated with said plurality of applicator members respectively, the magnetic fields of said electromagnets, when energized, causing the nap bristles to stand up on said applicator members to contact such pattern-carrying means; and means for selectively energizing and deenergizing said electromagnets respectively, in response to movement of related charge patterns in juxtaposition with the plurality of applicator members, to develop only selected charge patterns with the developer material attracted to such patterns from such bristles.

5. The invention of claim 4 wherein said energizing means includes means for detecting electrostatic charge patterns on the pattern-carrying means, and means associated with said detecting means for actuating a particular one of said plurality of electromagnets in response to detection of a selected one of such patterns so as to develop only such selected pattern with developer material from the bristles standing up on the applicator member associated with said one electromagnet.

* * * * *